US006682365B1

(12) United States Patent
Walker et al.

(10) Patent No.: US 6,682,365 B1
(45) Date of Patent: Jan. 27, 2004

(54) STACKED CONNECTOR WITH PLASTIC PART ASSEMBLED THERETO

(75) Inventors: Kevin E. Walker, Hershey, PA (US); James H. Hyland, Hummelstown, PA (US); Tod M. Harlan, Mechanicsburg, PA (US); Robert W. Brown, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/289,028

(22) Filed: Nov. 5, 2002

(51) Int. Cl.[7] ..... H01R 3/00
(52) U.S. Cl. ..... 439/488; 439/676; 439/541.5
(58) Field of Search ..... 439/488, 676, 439/620, 541.5

(56) References Cited

U.S. PATENT DOCUMENTS

| | | | | |
|---|---|---|---|---|
| 4,978,317 A | | 12/1990 | Pocrass | 439/490 |
| 5,362,257 A | | 11/1994 | Neal et al. | 439/676 |
| 5,687,233 A | * | 11/1997 | Loudermilk et al. | 379/442 |
| 6,116,946 A | | 9/2000 | Lewis et al. | 439/490 |
| 6,159,039 A | | 12/2000 | Wu | 439/541.5 |
| 6,162,089 A | | 12/2000 | Costello et al. | 439/541.5 |
| 6,183,292 B1 | | 2/2001 | Chen et al. | 439/541.5 |
| 6,227,911 B1 | | 5/2001 | Boutros et al. | 439/620 |
| 6,368,151 B1 | * | 4/2002 | Chen et al. | 439/541.5 |
| 6,520,799 B1 | * | 2/2003 | Cheng et al. | 439/541.5 |
| 6,540,564 B1 | * | 4/2003 | Ko | 439/676 |
| 2002/0146940 A1 | | 10/2002 | Colantuono et al. | 439/676 |

* cited by examiner

*Primary Examiner*—Tulsidas Patel
(74) *Attorney, Agent, or Firm*—Wei Te Chung

(57) ABSTRACT

An electrical connector (1) has a metal shield (3), a main housing (5), a pair of LEDs (6) received in the main housing, a subassembly (7) assembled to the main housing, a stacked Universal Serial Bus (USB) 4, and a molded assembly (2) assembled to the subassembly. Each LED (61, 62) has a plurality of leads (611, 621), a free end (612) of the middle lead of the LED is bent perpendicularly and extending horizontally thereafter below the other leads. The molded assembly comprising a plastic part (24), and a first and second connections (22, 23) insert molded in the plastic part. The plastic part has a pair of supporting posts (243) and a pair of positioning posts (245) extending from corresponding supporting posts. Each supporting post defines a channel (244) in a middle portion thereof.

14 Claims, 9 Drawing Sheets

STACKED CONNECTOR WITH PLASTIC PART ASSEMBLED THERETO

CROSS-REFERENCE TO RELATED APPLICATION

This present application is related to a U.S. patent application Ser. No. 10/232,879, invented by Iosif R. Korsunsky et al., filed on Aug. 29, 2002, entitled "MODULAR JACK ASSEMBLY HAVING IMPROVED POSITIONING MEANS"; Ser. No. 10/264,450, invented by Kevin Eugene Walker and Leonard Kay Espenshade, entitled "STACKED CONNECTOR WITH LEDS"; application Ser. No. 10/234,567, invented by Leonard Kay Espenshade, entitled "SHIELDED ELECTRICAL CONNECTOR ASSEMBLY HAVING RELIABLE GROUNDING CAPABILITIES"; application Ser. No. 10/264,611, invented by Leonard Kay Espenshade and Kevin Eugene Walker, entitled "STACKED CONNECTOR WITH LEDS" application Ser. No. 10/236,614, invented by Leonard Kay Espenshade and Kevin Eugene Walker, entitled "STACKED ELECTRICAL CONNECTOR ASSEMBLY HAVING EASILY DETACHABLE ELECTRONIC MODULE; and application Ser. No. 10/236,615, invented by Leonard Kay Espenshade and Kevin Eugene Walker, entitled "ELECTRICAL CONNECTOR ASSEMBLY HAVING GROUND MEMBER" contemporaneously filed and assigned to the common assignee. Copies of the specifications are hereto attached.

BACKGROUND OF THE INVENTION

1. Field of the Invention

The present invention generally relates to an electrical connector, and more particularly to an electrical connector with light-emitting devices (LEDs).

2. Description of the Prior Art

Following the development of network industry, a variety of types of connectors are proposed to meet different requirements. The connectors general have light-emitting devices for indicating full mating of complementary connectors.

U.S. Pat. No. 6,227,911, issued to Boutros on May 8, 2001, discloses an electrical connector having a housing, and two different LED sub-modules. The LED sub-modules have pockets for accommodating LEDs, and grooves for accommodating the leads of the LEDs. The leads of the LEDs extend horizontally before the LED are assembled to the LED sub-modules, and the leads of the LEDs are bent vertically after they are assembled to the LED sub-modules. The leads of the LEDs are soldered to a printed circuit board (PCB) of an outer device.

U.S. Pat. No. 4,978,317, issued to Pocrass on Dec. 18, 1990, discloses an electrical connector. The electrical connector of Pocrass has a housing, an LED positioned within the housing, the LED has a plurality of lead wires. The housing has a top wall and a bottom wall, the lead wires of the LED extending along the top wall of the housing, extending through the bottom wall and then plug into a printed circuit board (PCB).

However, as the leads of the LEDs of the above mentioned patents are bent downwardly to be soldered to or extend through the PCB, as the standard LEDs has a standard length, so the leads of the LEDs can not have enough length to be soldered to or extend through the PCB after they are bent if the connectors are a little higher.

Hence, an improved connector is needed to eliminate the above mentioned defects of the conventional connectors.

BRIEF SUMMARY OF THE INVENTION

The object of the present invention is to provide an electrical connector having a molded assembly with a plastic part of special structure.

An electrical connector of the present invention has an insulative main housing, a subassembly having a magnetic assembly and a contact array assembly, a stacked Universal Serial Bus connector (USB), a molded assembly, and a metal shield. The main housing has a pair of slots. Each LED has a plurality of leads, a free end of the middle lead of the LED is bent perpendicularly and extending horizontally thereafter below the other leads. The molded assembly comprises a plastic part, and a first and second connections insert molded in the plastic part. The first and second connections have engaging sections, soldering sections, and retaining sections connecting the soldering sections with the engaging sections. The plastic part has a pair of supporting posts extending horizontally on an upper portion thereof, and a pair of positioning posts extending from the corresponding supporting posts and received in corresponding slots of the main housing. Each supporting post defines a channel, and the middle one of the soldering sections of the second connection is received in a corresponding channel of the supporting post. The free ends of the leads are respectively soldered to soldering sections of the first and second connections.

Other objects, advantages and novel features of the invention will become more apparent from the following detailed description of a preferred embodiment when taken in conjunction with the accompanying drawings.

DETAILED DESCRIPTION OF THE INVENTION

Figure 1:
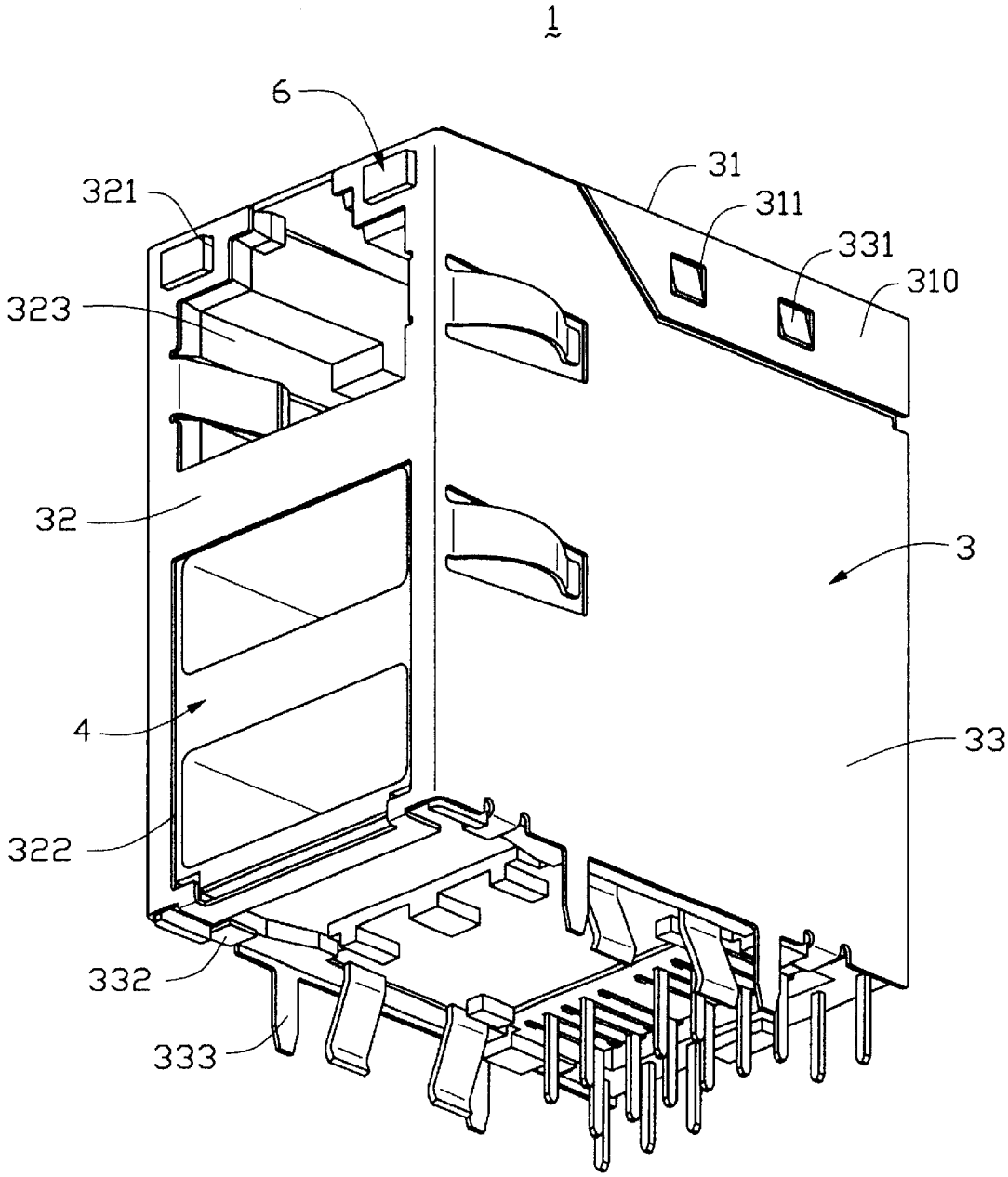
FIG. 1 is a perspective view of an electrical connector of the present invention.
Figure 2:
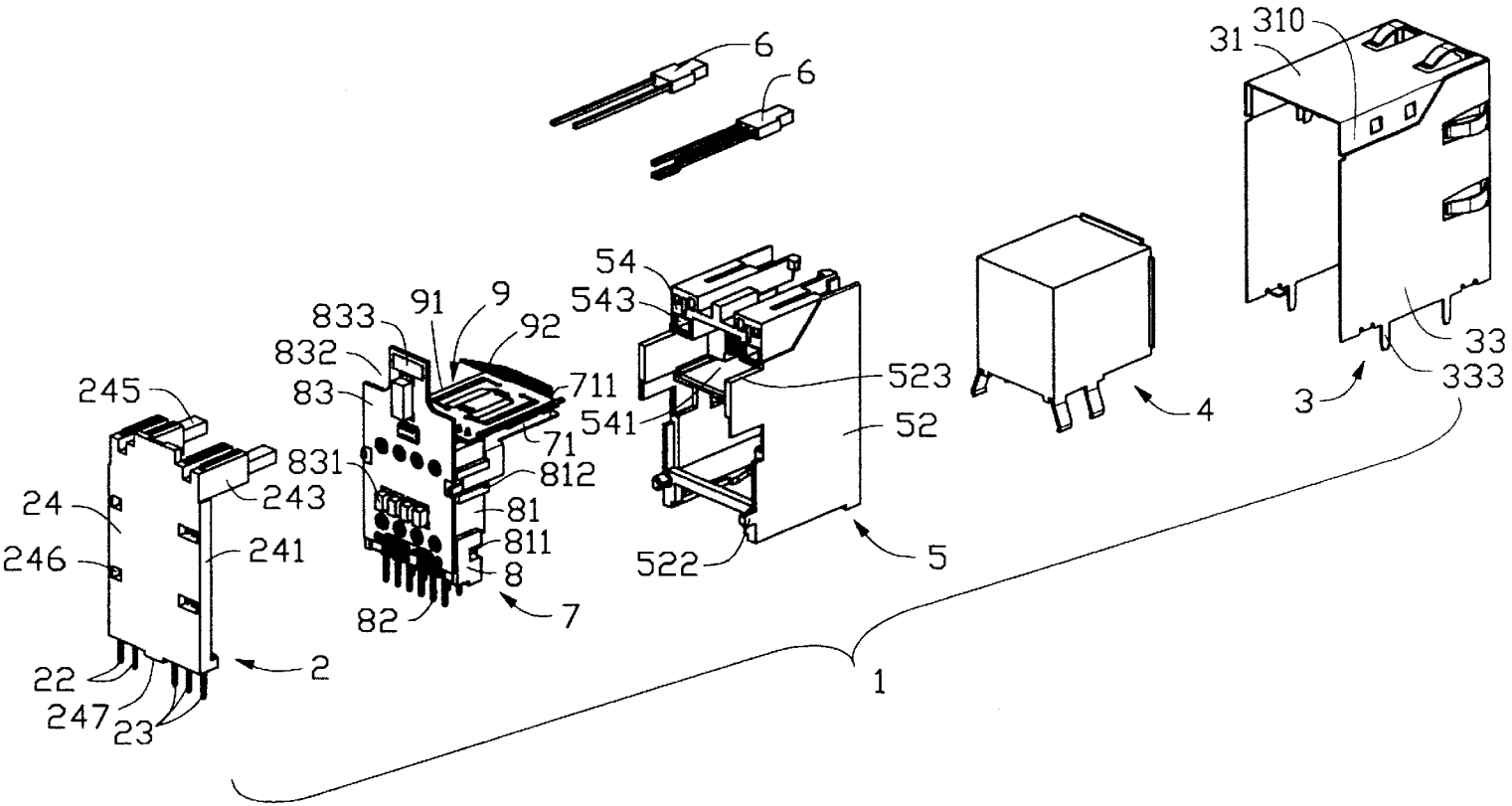
FIG. 2 is an exploded view of FIG. 1.

Referring to FIGS. 1 and 2, an electrical connector 1 of the present invention has a shield 3, a main housing 5, a pair of light-emitting devices (LEDs) 6, a stacked Universal Serial Bus connector (USB) 4, a subassembly 7, and a molded assembly 2.

The shield 3 has a top wall 31, a front wall 32, and two side walls 33. The top wall 31 has a pair of side portions 310 respectively extending from two lateral side edge of the top wall 31. Each side portion 310 defines a pair of mounting holes 311. Each side wall 33 forms a pair of mounting tabs 331 on an upper portion thereof for engaging with corresponding mounting holes 311 of the top wall 31, and each side wall 33 has a pair of grounding tabs 333 and a pair of retentive tabs 332. The front wall 32 of the shield 3 has a pair of LED receiving cavities 321 on an upper portion thereof, a USB opening 322, and a first opening 323 defined above the USB opening 322.

Figure 3:
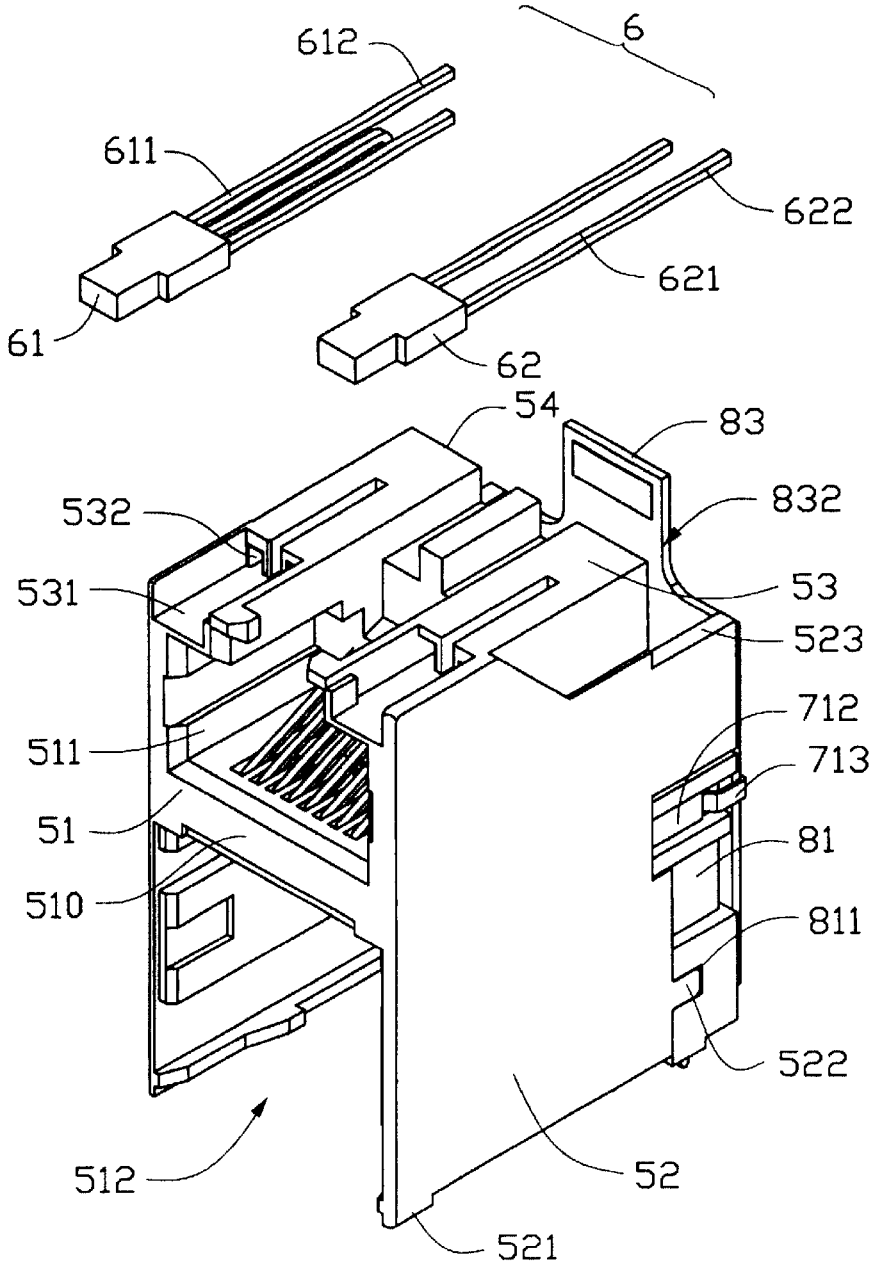
FIG. 3 is a partial assembly view of FIG. 2, with a subassembly and a main housing assembled.

Referring to FIGS. 2 and 3, the main housing 5 is substantially a cubic and has a front wall 51, a pair of side walls 52, a top wall 53 and a rear wall 54. The main housing 5 has a partitioner 510 separating an interior space (not labeled) thereof into a first cavity 511 and a second cavity 512. Each side wall 52 has a standoff 521 extending downwardly from a bottom edge thereof and a locating post 522 extending rearwardly therefrom. The top wall 53 defines a pair of apertures 531 in a front portion thereof and a plurality of passageways 532 communicating with corresponding apertures 531. The rear wall 54 defines a pair of slots 543 respectively adjacent to the side walls 52, and a first groove 541 and a second groove (not shown) respectively above and below the partitioner 510. The side walls 52 of the main housing 5 respectively have bearing portions 523 extending rearwardly from the side walls 52.

The LEDs 6 has a bi-color LED 61 and a single color LED 62. The bi-color LED has three leads 611, one of the leads 611 extends longer than the others. The free end 612 of the middle one of the leads 611 of the bi-color LED 61 is bent downwardly and rearwardly, and then extends parallel to the other leads 611 of the bi-color LED 61. The single color LED 62 has two leads 621, one of the leads 621 extends longer than the other.

Figure 7:
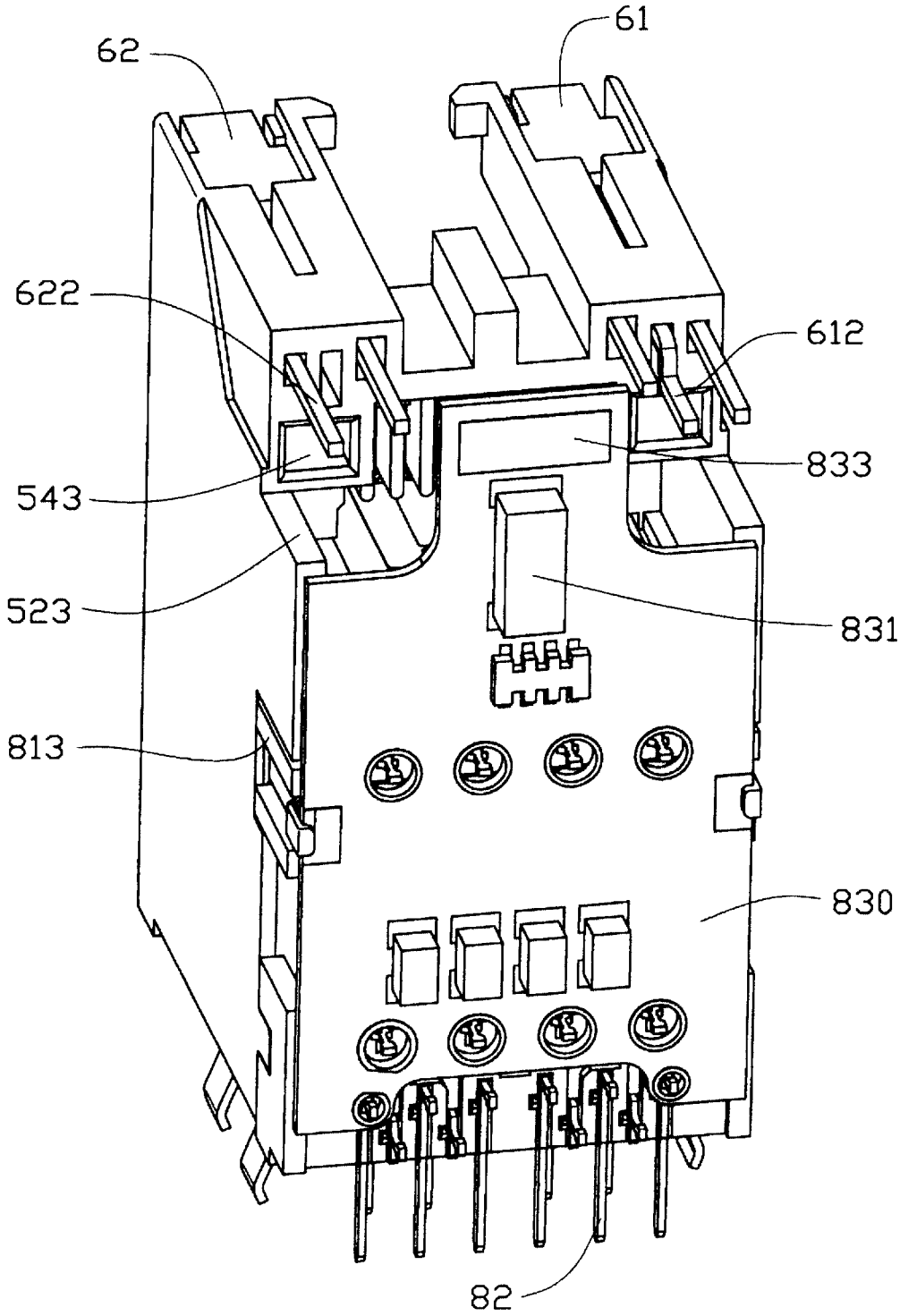
FIG. 7 is a partial assembly view of the electrical connector.
Figure 8:
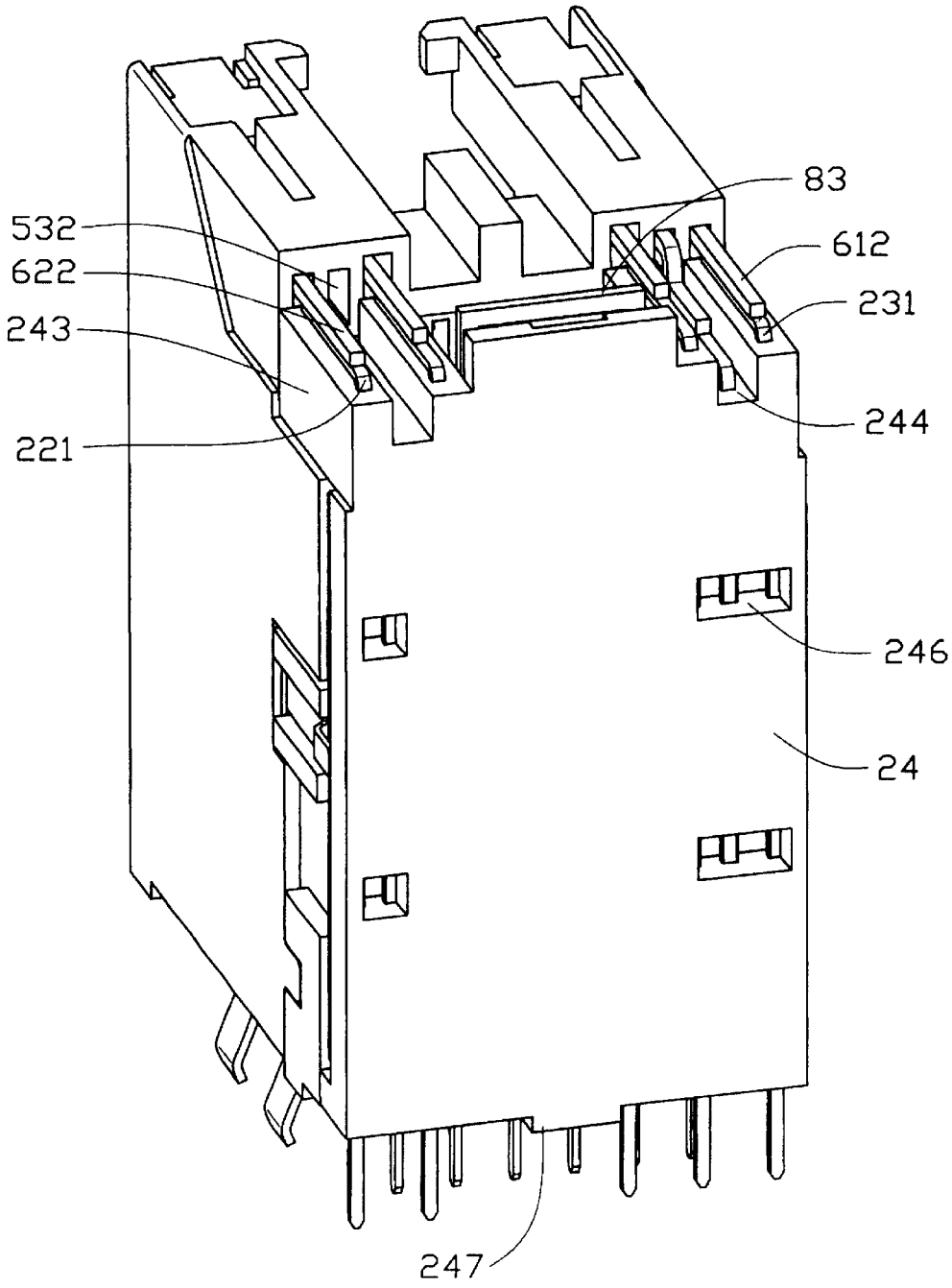
FIG. 8 is another partial assembly view of the electrical connector, wherein a molded subassembly is assembled thereto.

The subassembly 7 has a grounding terminal 71, a magnetic assembly 8 and a contact array assembly 9. The grounding terminal 71 has a flat portion 711, a pair of spring fingers (not labeled) formed on the flat portion 711, a pair of engaging portions 712 respectively extending rearwardly from opposite sides of the flat portion 711, and a pair of grounding tails 713 extending from free ends of corresponding engaging portions 712. The magnetic assembly 8 has a first insulative housing 81, a plurality of magnetic coils (not shown) received in an interior space of the first housing 81, a vertical printed circuit board (PCB) 83 assembled to the first housing 81, and a plurality of signal and grounding contacts 82 received in the first housing 81. The first housing 81 has a pair of keys 811 adjacent to a bottom portion thereof, two pairs of ribs 813 (shown in FIG. 7) formed on corresponding lateral sides thereof and a recess 812 defined between each pair of ribs 813. The vertical PCB 83 has a plurality of filtering elements 831 arranged thereon, a pair of cutouts 832 defined in an upper portion of the vertical PCB 83, and a pair of grounding pads 833 respectively formed on opposite surfaces thereof. The engaging portions 712 of the grounding terminal 71 are respectively received in corresponding recesses 812 of the first housing 81, and the grounding tails 713 abut against opposite side edges of the vertical PCB 83 of the magnetic assembly 8, thus the grounding terminal 71 straddles the vertical PCB 83. The contact array assembly 9 has a first PCB 91 and a plurality of terminals 92 soldered to the first PCB 91.

Figure 4A:
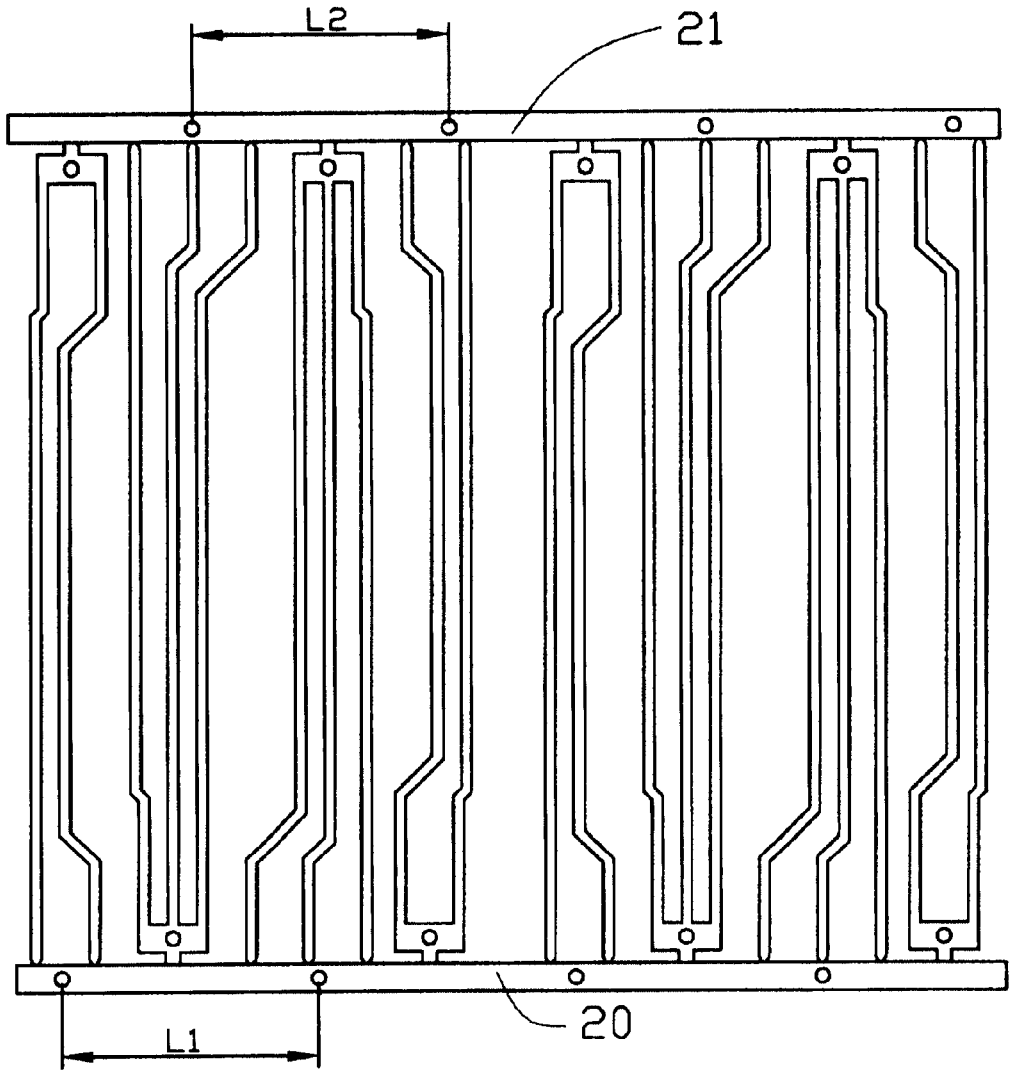
FIGS. 4*a*–4*c* are top views of material strips of connections prior to being assembled to the electrical connector.
Figure 4B:
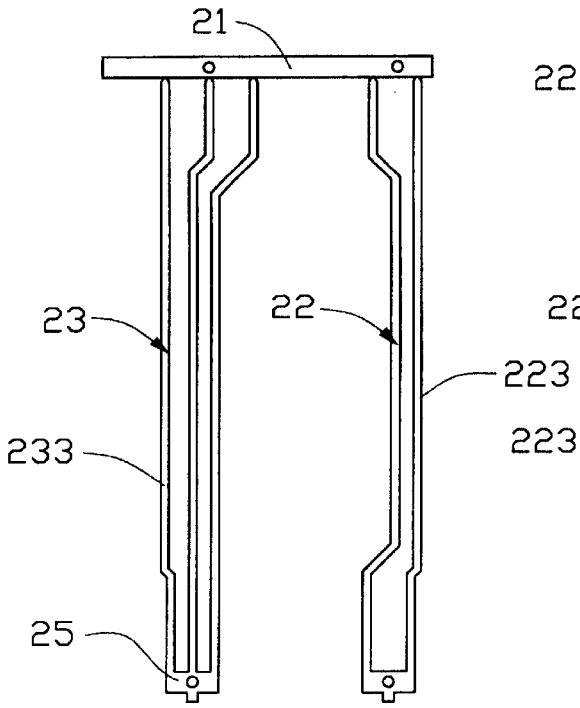
Figure 4C:
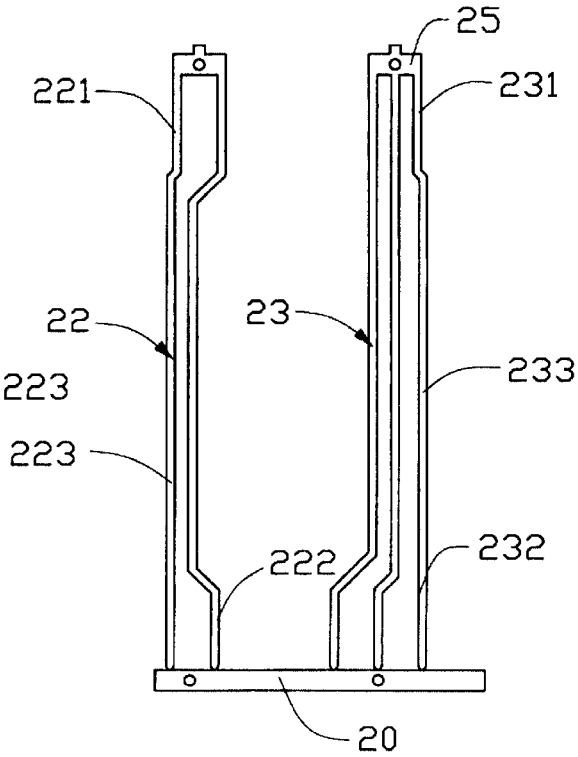
Figure 5:
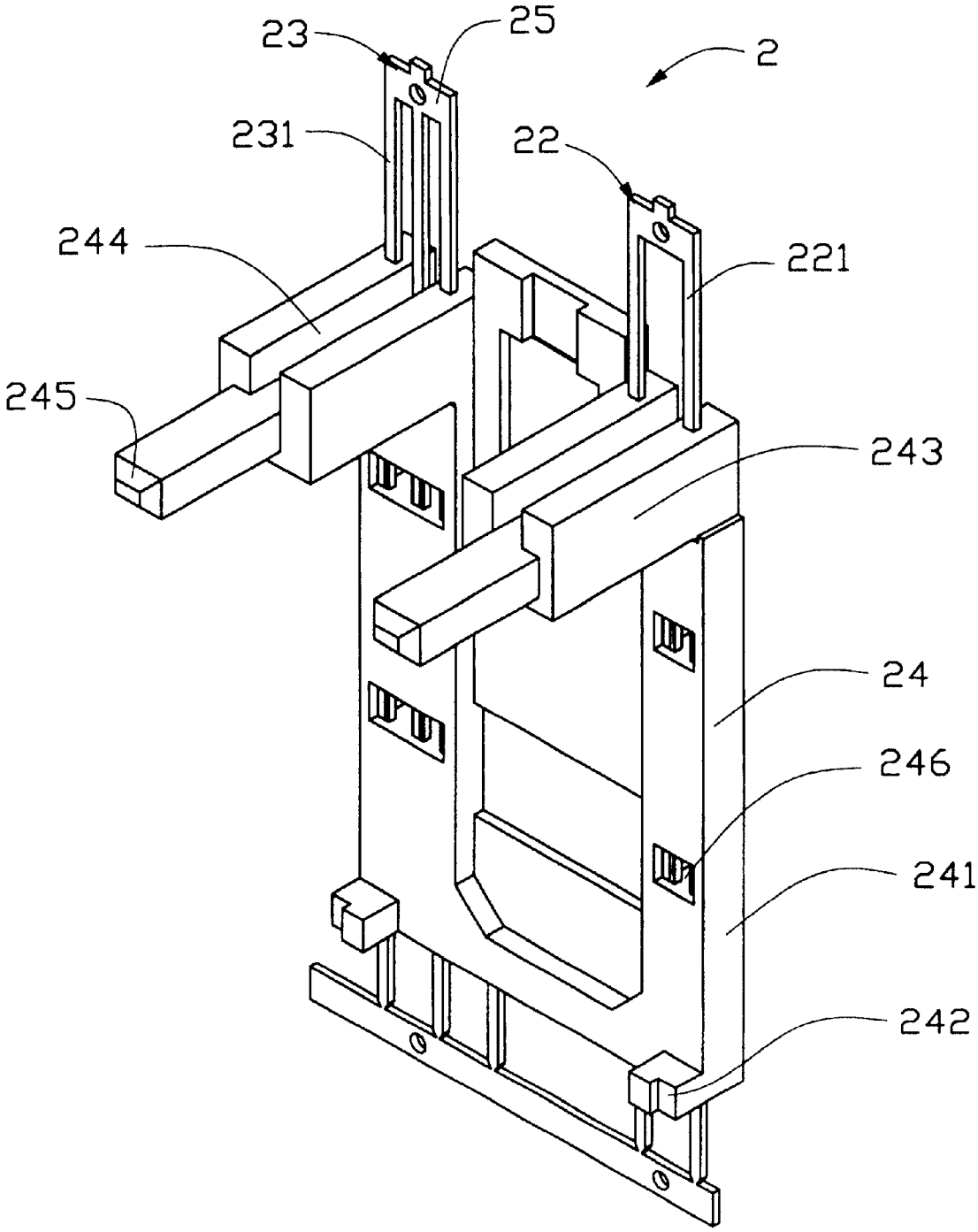
FIG. 5 is a perspective view of a molded assembly of the electrical connector, wherein soldering sections of connections insert molded in the molded assembly are not bent.
Figure 6:
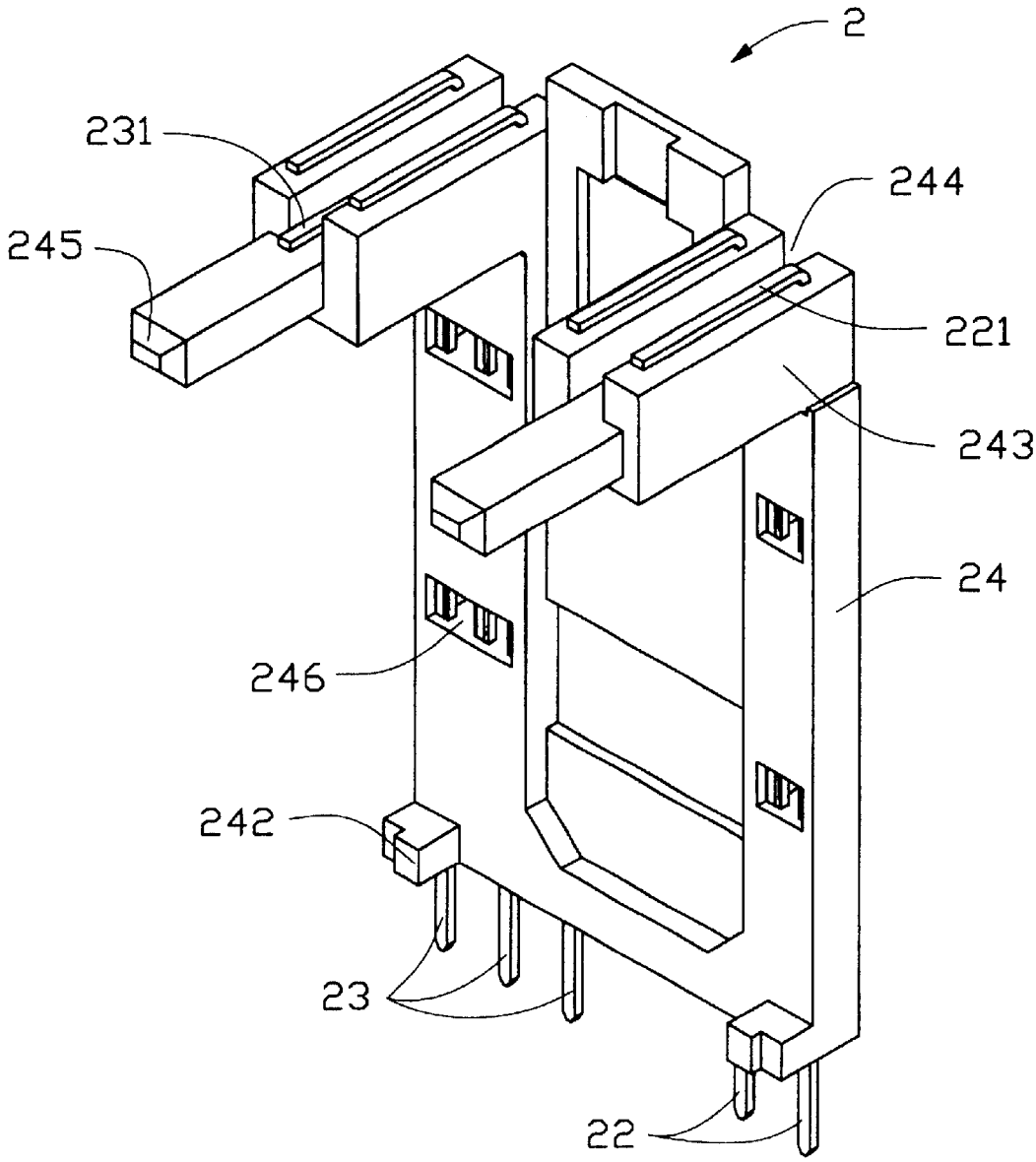
FIG. 6 is a perspective view of a molded subassembly of the electrical connector, wherein soldering sections of connections are bent.

Referring to FIGS. 5 and 6, the molded assembly 2 has a plastic part 24, a first connection 22 and a second connection 23 respectively molded in the plastic part 24. The plastic part 24 has a flat plate 241, opposite protrusions 242 protruding forwardly from a lower portion of the flat plate 241, and a pair of supporting posts 243 protruding horizontally from an upper portion of the flat plate 241. Each supporting post 243 has a positioning post 245 extending from a free end of the supporting post 243. Each supporting post 243 defines a channel 244 in a middle portion thereof. Referring to FIG. 4*a*–4*c*, the first and second connections 22, 23 respectively have soldering sections 221, 231, engaging sections 222, 232, and retaining sections 223, 233 connecting the soldering sections 221, 231 and engaging sections 222, 232.

Referring to FIGS. 1–8, in assembly, the engaging portions 712 of the grounding terminal 71 engage with corresponding recesses 812 of the first housing 81, and the grounding tails 713 of the grounding terminal 71 abut against lateral sides of the vertical PCB 83. The contact array assembly 9 of the subassembly 7 projects through the first groove 541 into the first cavity 511 of the main housing 5, the grounding terminal 71 projects through the second groove into the second cavity 512 of the main housing 5, the locating posts 522 of the main housing 5 engage with corresponding keys 811 of the first housing 81 of the subassembly 7, the bearing portions 523 of the main housing 5 are sustained by the ribs 813 of the main first housing 81. The leads 611, 621 of the bi-color LED 61 and single color LED 62 respectively project through corresponding passages 532 of the main housing 5. The bi-color LED 61 and the single color LED 62 are respectively received in corresponding apertures 531 of the main housing 5. The stacked USB 4 is received in the second cavity 512 of the main housing 5. The plastic part 24 of the molded assembly 2 is assembled to the main housing 5 and subassembly 7. The positioning posts 245 are positioned in corresponding slots 543 of the main housing 5. The supporting posts 243 of the plastic part 24 are respectively supported by upper edges of the bearing portions 523 of the main housing 5. The protrusions 242 of the plastic part 24 are received in corresponding depressions (not labeled) of the first housing 81 of the magnetic assembly 8. The retaining sections 223, 233 of the first and second connections 22, 23 are exposed from the corresponding openings 246 of the plastic part 24, so that the space between every two retaining sections 223, 233 can be controlled from the opening 246. As the leads 612, 622 of the bi-color LED 61 and the single color LED 62 is a little lower than top surfaces of the supporting posts 243 of the plastic part 24, the soldering sections 221, 231 of the first and second connections 22, 23 respectively tightly connect corresponding free ends 622, 612 of the leads 611, 621. The LED receiving openings 321 of the shield 3 receive corresponding LEDs 6, the first opening and USB opening 323, 322 of the shield 3 are respectively aligned with corresponding first and second cavities 511, 512 of the main housing 5, and the mounting tabs 331 of side walls 33 of the shield 3 respectively engage with corresponding mounting holes 311 of the top wall 31 of the shield 3.

Referring to FIGS. 4*a*–6, a method of making the first and second connections 22, 23 and the plastic part 24 has steps mentioned herein.

(a) stamping a metal sheet into a plurality of first and second connections 22, 23, each first connection 22 separating a first and second connections 22, 23, and each second connection 23 separating a first and second connections 22, 23, wherein the engaging sections 222, 232 of the side-by-side first and second connections 22, 23 respectively connecting a first and second carriers 20, 21 and connecting portions 25 connecting the first and second soldering sections 221, 231 to corresponding second and first carriers 20, 21;

(b) a first distance L1 between the first connection 22 and the second connection 23 both connecting to the first carrier 20 being equal to a second distance L2 between the second connection 23 and the first connection 22 both connecting to the second carrier 21;

(c) severing a pair of first and second soldering sections 221, 231 both connecting to the first carrier 20 from the first carrier 20, and severing another pair of the first and second soldering sections 221, 231 both connecting to the second carrier 21 from the second carrier 21 at the same time;

(d) insert molding the first and second connections 22, 23 in the plastic part 24, then severing the first carrier 20 and second carrier 21 and the connecting portions 25 from the first and second connections 22, 23;

(e) bending the first and second soldering sections 221, 231 of the first and second connections 22, 23 toward corresponding supporting posts 243 of the plastic part 24 and extending horizontally and forwardly, the middle soldering sections 231 of the second connection 23 being bent and received in the channel 244 of the plastic part 24.

In use, the electrical connector 1 is disposed on a PCB of a peripheral equipment (not shown), the grounding tabs 333 engaging with the PCB of the peripheral equipment, the contacts 82 of the subassembly 7 engage with proper circuit traces of the PCB of the peripheral equipment.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a main housing, the housing defining a plurality of passageways, and a pair of slots adjacent to the passageways;

a pair of LEDs, each LED having a plurality of leads respectively received in corresponding passageways;

a molded assembly, the molded assembly having a plastic part, a pair of connections insert molded in the plastic part, the plastic part having a pair of supporting posts, and a pair of positioning posts extending from corresponding supporting posts, the supporting posts and the plastic part being in a substantially L-shaped configuration; wherein the positioning post engaging with corresponding slots of the main housing, and the leads of the LEDs electrically connecting with corresponding connections.

2. The electrical connector as claimed in claim 1, wherein each supporting post of the plastic part defines a channel, one of the connections has a soldering section received in a corresponding channel of the supporting post.

3. The electrical connector as claimed in claim 1, wherein the electrical connector has a subassembly, the subassembly having a magnetic assembly, the magnetic assembly having a first housing and a vertical printed circuit board (PCB) assembled to the first housing.

4. The electrical connector as claimed in claim 3, wherein the vertical PCB defines a pair of cutouts on an upper portion thereof for the supporting posts of the plastic part projecting through.

5. The electrical connector as claimed in claim 1, wherein the plastic part has a pair of protrusions on a bottom portion thereof for attaching the plastic part to the subassembly.

6. The electrical connector as claimed in claim 1, wherein the plastic part has a plurality of openings, the connections respectively have retaining sections partially exposed from the openings of the plastic part for controlling the space between every two retaining sections.

7. An electrical connector comprising:

a main housing;

an LED, the LED has a plurality of leads;

a subassembly having a vertical printed circuit board (PCB) and a contact array assembly disposed perpendicularly to the vertical PCB; and a molded assembly, the molded assembly having a plastic part having a supporting post, a connection insert molded in the plastic part, the connection having a plurality of soldering sections bent to the supporting post;

wherein each lead of the LED electrically connect with corresponding soldering section of the connection, and the leads are slightly higher than a top surface of the supporting post.

8. The electrical connector as claimed in claim 7, wherein the plastic part having a positioning post extending from the supporting post thereof, the main housing defines a slot receiving the positioning post of the plastic part.

9. The electrical connector as claimed in claim 7, wherein the supporting post has a channel defined therein, one of the soldering sections of the connection is received in the channel of the supporting post.

10. The electrical connector as claimed in claim 7, wherein the plastic part of the molded assembly has a pair of protrusions extending from a bottom portion thereof for attaching the plastic part to the housing.

11. The electrical connector assembly, comprising:

a housing including a built-in electronic component with a plurality of leads extending therefrom in a horizontal direction; and a molded assembly assembled to a rear portion of said housing, said molded assembly including an L-shaped plastic part with a plurality of L-shaped conductive contacts embedded therein, said plastic part including a first horizontal section forwardly retainably inserted into the housing from a rear face of the housing under a condition that a horizontal portion of each of said leads abuts against a horizontal portion of a corresponding one of said conductive contacts which is supported by a second horizontal section of said plastic part.

12. The assembly as claimed in claim 11, wherein said horizontal portion of the lead is sandwiched between the horizontal portion of the corresponding conductive contact and the corresponding second horizontal section of the plastic part.

13. The assembly as claimed in claim 11, wherein said second horizontal section defines two levels for supporting tails of the leads at said two different levels.

14. The assembly as claimed in claim 11, wherein said electronic component is an LED.

* * * * *